US007712270B2

(12) United States Patent
Guevremont

(10) Patent No.: US 7,712,270 B2
(45) Date of Patent: May 11, 2010

(54) BUILDING PANEL

(76) Inventor: Clément Guevremont, 1777, Cédar, Mascouche, Quebec (CA) J7L 1W6

( * ) Notice: Subject to any disclaimer, the term of this patent is extended or adjusted under 35 U.S.C. 154(b) by 260 days.

(21) Appl. No.: 11/653,313

(22) Filed: Jan. 16, 2007

(65) Prior Publication Data

US 2008/0168735 A1 Jul. 17, 2008

(51) Int. Cl.
*E04H 1/00* (2006.01)

(52) U.S. Cl. ..... 52/235; 52/592.1; 52/779; 52/745.2; 52/592.3

(58) Field of Classification Search ..... 52/264, 52/266, 271, 284, 483.1, 578, 585.1, 591.1, 52/592.3, 592.4, 592.5, 592.6, 506.05, 569, 52/270, 747.1, 436, 596.1, 285.1, 591.4, 52/592.1, 79.9, 474, 475.1, 479, 788, 789.1, 52/788.1, 798, 777, 764, 762, 780, 79.12, 52/783.1, 787.1, 792.1, 779, 604, 745.2, 52/592.2, 235

See application file for complete search history.

(56) References Cited

U.S. PATENT DOCUMENTS

| | | | | | |
|---|---|---|---|---|---|
| 502,289 | A | * | 8/1893 | Feldman | 52/578 |
| 713,577 | A | * | 11/1902 | Wickham | 52/467 |
| 1,157,469 | A | * | 10/1915 | Philp | 52/585.1 |
| 1,329,292 | A | * | 1/1920 | Christin | 52/600 |
| 1,409,284 | A | * | 3/1922 | De Fernelmont | 52/436 |
| RE17,144 | E | * | 11/1928 | Schwartz | 52/794.1 |
| 1,741,342 | A | * | 12/1929 | Schwartz | 52/580 |
| 2,178,097 | A | * | 10/1939 | Davison et al. | 52/223.6 |
| 2,526,116 | A | * | 10/1950 | Browne | 105/423 |
| 2,594,928 | A | * | 4/1952 | Horowitz | 52/284 |
| 2,777,318 | A | * | 1/1957 | Clarence | 52/404.4 |
| 2,844,022 | A | * | 7/1958 | Klem | 52/592.5 |
| 3,077,426 | A | * | 2/1963 | Johnston | 181/286 |
| 3,110,131 | A | * | 11/1963 | Nelson | 52/396.04 |
| 3,116,570 | A | * | 1/1964 | Torricelli | 52/436 |
| 3,444,660 | A | * | 5/1969 | Feichter et al. | 52/389 |
| 3,464,170 | A | * | 9/1969 | Morgan | 52/127.7 |
| 3,473,273 | A | * | 10/1969 | Dietrich | 52/79.1 |
| 3,530,633 | A | * | 9/1970 | Scott | 52/460 |
| 3,553,921 | A | * | 1/1971 | Breistein | 52/592.1 |
| 3,559,358 | A | * | 2/1971 | Lohse et al. | 52/379 |
| 3,685,228 | A | * | 8/1972 | Pauley | 52/506.05 |
| 3,751,867 | A | * | 8/1973 | Layne | 52/426 |
| 4,281,495 | A | * | 8/1981 | Lee | 52/584.1 |
| 4,395,854 | A | * | 8/1983 | White et al. | 52/64 |
| 4,593,511 | A | * | 6/1986 | Hakasaari | 52/404.4 |
| 4,614,071 | A | * | 9/1986 | Sams et al. | 52/309.12 |
| 5,148,850 | A | * | 9/1992 | Urbanick | 160/231.1 |
| 5,247,773 | A | * | 9/1993 | Weir | 52/592.3 |

(Continued)

*Primary Examiner*—Robert J Canfield
*Assistant Examiner*—Matthew J Gitlin
(74) *Attorney, Agent, or Firm*—Equinox Protection; Franz Bonsang, Patent Agent

(57) ABSTRACT

An improved building panel is presented to make wall surface assemblies on structural building frames. The edge-sealed building panel includes with self-aligning features between adjacent horizontal edges for quick mating and assembly. The building panels have protuberant upper edges mate with grooves on the lower edges for improved sealing and weatherproofing, due to the interlocking shape and the use of compliant seals between the edges. The horizontal mating edge shapes enable pivoting assembly by engaging the building panel obliquely and swinging it onto the wall surface. Vertical mating surfaces with compliant seals are shaped to engage perpendicularly to the wall plane, so that the compliant seals clamp shut without in-plane relative motion, improving seal integrity.

17 Claims, 4 Drawing Sheets

U.S. PATENT DOCUMENTS 5,295,341 A * 3/1994 Kajiwara ..... 52/586.2
5,577,356 A * 11/1996 Hubbard et al. ..... 52/233
5,628,158 A * 5/1997 Porter ..... 52/309.9
6,000,178 A * 12/1999 Goodings ..... 52/235
6,023,907 A * 2/2000 Pervan ..... 52/748.1
6,122,880 A * 9/2000 Kolb et al. ..... 52/592.6
6,134,853 A * 10/2000 Haener ..... 52/405.2
6,167,670 B1 * 1/2001 Reite et al. ..... 52/637
6,216,410 B1 * 4/2001 Haberman ..... 52/591.1
6,345,481 B1 * 2/2002 Nelson ..... 52/592.2
6,352,657 B1 3/2002 Veldhuis et al.
6,389,773 B1 * 5/2002 Reuter et al. ..... 52/582.2
6,438,915 B1 * 8/2002 Beauboeuf ..... 52/271
6,502,357 B1 * 1/2003 Stuthman et al. ..... 52/241
6,505,452 B1 * 1/2003 Hannig et al. ..... 52/582.1
6,536,178 B1 * 3/2003 Panglsson et al. ..... 52/589.1
6,625,937 B1 * 9/2003 Parker et al. ..... 52/79.7
6,672,030 B2 * 1/2004 Schulte ..... 52/747.1
6,772,569 B2 * 8/2004 Bennett et al. ..... 52/592.1
6,789,977 B2 9/2004 Layfield
6,817,151 B2 * 11/2004 Foderberg et al. ..... 52/414
6,931,803 B1 * 8/2005 Davis et al. ..... 52/251
6,955,026 B2 * 10/2005 Misonou ..... 52/786.13
6,962,027 B2 * 11/2005 Zawinsky ..... 52/585.1
6,974,383 B2 * 12/2005 Lewis et al. ..... 454/338
6,996,945 B2 * 2/2006 Doty ..... 52/585.1
7,093,398 B2 * 8/2006 Spransy et al. ..... 52/586.2
7,117,647 B2 * 10/2006 Clarke ..... 52/233
7,121,058 B2 * 10/2006 Palsson et al. ..... 52/592.2
7,150,135 B2 * 12/2006 Becker ..... 52/592.1
7,313,890 B2 * 1/2008 Clarke ..... 52/233
7,337,588 B1 * 3/2008 Moebus ..... 52/592.4
7,484,337 B2 * 2/2009 Hecht ..... 52/578
2003/0140588 A1 * 7/2003 Sucato, Jr. ..... 52/506.01
2003/0154672 A1 * 8/2003 Spransy et al. ..... 52/238.1
2003/0159385 A1 * 8/2003 Thiers ..... 52/311.1
2003/0196405 A1 * 10/2003 Pervan ..... 52/592.1
2004/0035080 A1 * 2/2004 Becker ..... 52/592.1
2004/0068939 A1 * 4/2004 Beser et al. ..... 52/79.9
2004/0206037 A1 * 10/2004 Bennett ..... 52/578
2007/0051064 A1 * 3/2007 Thiers ..... 52/592.1
2007/0062148 A1 * 3/2007 Nienhuis et al. ..... 52/592.1
2007/0251182 A1 * 11/2007 Van Steinburg ..... 52/586.1
2008/0115433 A1 * 5/2008 Towersey et al. ..... 52/284
2008/0216430 A1 * 9/2008 Gleeson et al. ..... 52/506.1

* cited by examiner

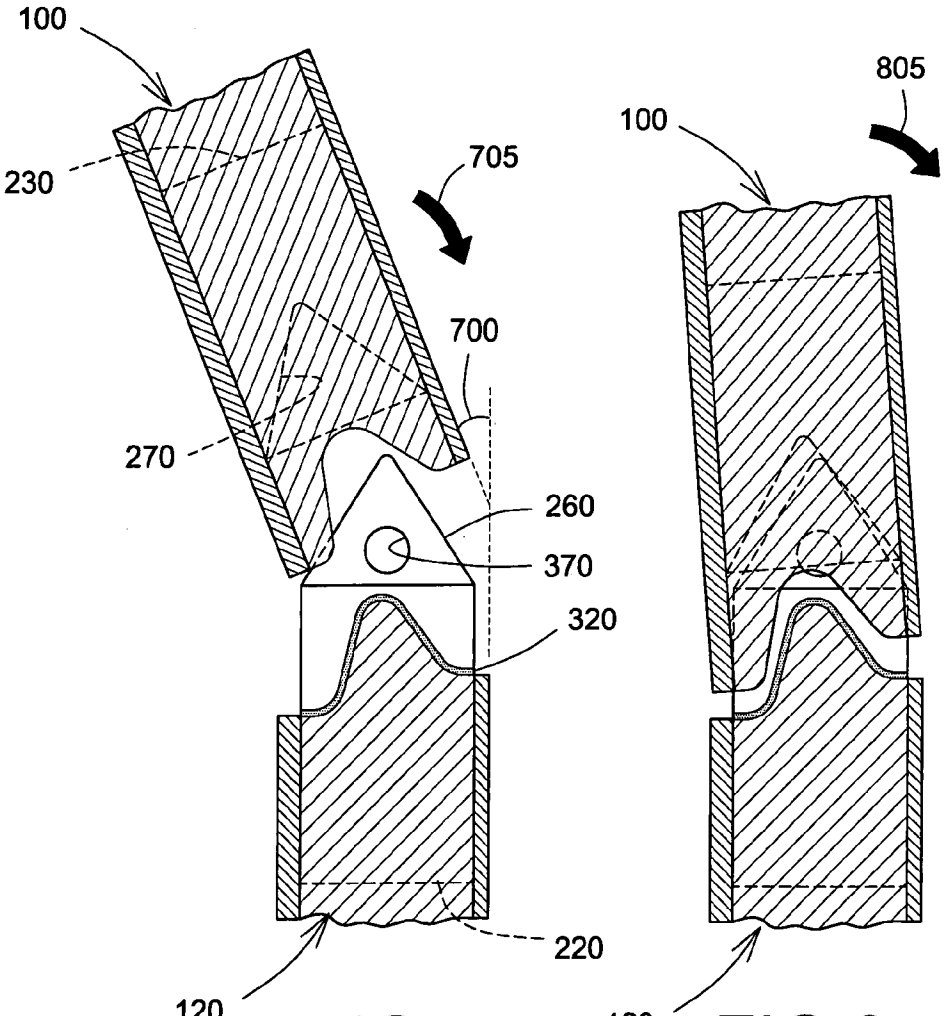
FIG.7
FIG.8
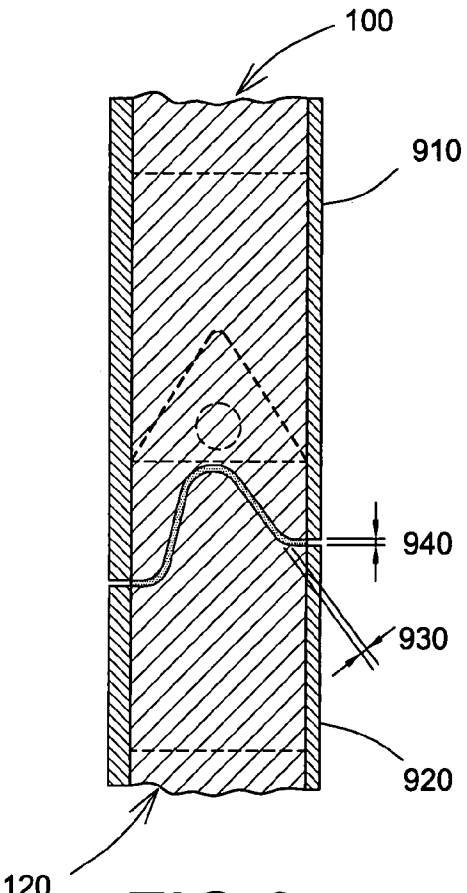
FIG.9

BUILDING PANEL

FIELD OF THE INVENTION

The present invention relates to building panels and methods and is more particularly concerned with wall-surface building panels with quick-assembly features and improved joint sealing, and method of installation thereof.

BACKGROUND OF THE INVENTION

It is well known in the art to use building panels to make wall or partition surface assemblies on structural building frames.

There are various requirements for such building panel assemblies. In particular the panels must be capable of quick, simple and reliable assembly. This will ensure that wall surfaces can be rapidly built, with minimal risk of damage to the wall panels during assembly.

In the case of an exterior wall, the joints should protect the building from the ingress of wind, moisture, and other environmental factors. In the case of an interior partition, the joints should be draftproof.

The problems encountered by existing panels are numerous. As the concept of panel modularity evolved, panels became larger in the interests of faster assembly time since obviously fewer large panels would be needed to complete a wall surface when compared to, for example, smaller panels or even bricks.

Large panels present various drawbacks, some of which are their increased weight and bulk, making it difficult to manoeuvre, position and attach the large panels to a building structure. Add to this the difficulty in sealing the edges of adjacent panels, such difficulty being accentuated the taller or more inaccessible the building structure becomes.

Furthermore, large panels, once installed, are not removable from the building structure without damages to the panels and/or the structure, thus preventing the re-installation of the panels on another structure or simply on the same building structure after relocation thereof.

Attempts have been made previously to seal the edges of adjacent panels with rubber sill garage doors sealing or windows rubber hoses sealing system but among the consistent drawbacks has been the frequent damage to sealing surfaces while the panels are handled, and during the building assembly activity. The damage to the sealing surfaces is often difficult to detect and repair during construction, resulting in drafty, leaky buildings that require repair as soon as they are placed in service.

Accordingly, there is a need for an improved building panel with modular, self-aligning, quick-assembly interfaces providing sealing and weatherproofing.

SUMMARY OF THE INVENTION

It is therefore a general object of the present invention to provide an improved wall surface building panel, and a method of installation thereof.

An advantage of the present invention is that the wall surface building panel provides for quick making of a wall surface with sealed weatherproof joints that are more damage-resistant.

An advantage of the present invention is that the wall surface building panel has self-aligning piloting features.

Another advantage of the present invention is that the wall surface building panel has improved joint sealing and weatherproofing, typically using of a stable (in the ways of being non-shrinkable, waterproof and always staying precisely fit for installation) and thermally non conductive (for insulation) material.

A further advantage of the present invention is that the wall surface building panel can be assembled and/or disassembled quickly.

Still another advantage of the present invention is that the wall surface building panel has joint sealing that is more resistant to installation damage.

According to an aspect of the present invention, there is provided a wall surface building panel securable to a structural building frame having vertical connector strips connected thereto, said panel comprises: a generally planar panel body having elongate opposite upper and lower edge-defining structures, and elongate opposite first and second lateral edge-defining structures extending therebetween, said panel body having an outer width and an inner width; an elongate protuberant structure operatively associated with, and extending along, the upper edge-defining structure generally in a plane of the body; an elongate groove structure operatively associated with, and extending along, the lower edge-defining structure generally in the plane of the body, and being generally complementarily compatible with said protuberant structure; oblique vertical mating structures operatively associated with, and extending along, the first and second lateral edge-defining structures, complementarily compatible with the corresponding vertical connector strips, wherein the oblique vertical mating structures are arranged so that the outer width of the planar panel body is greater than the inner width thereof; wherein the elongate protuberant structure of a subjacent panel is shaped to releasably, pivotally and load-supportively interface with the elongate groove structure of said panel, said interfacing enabling a range of motion of said panel relative to the subjacent panel; wherein said range of motion ranges from a first position non-coplanar with the wall surface, to a second position generally coplanar with the wall surface; wherein said range of motion substantially reduces sliding contact between each said oblique vertical mating structures and corresponding said vertical connector strip; and wherein the elongate protuberant structure and the generally complementarily compatible elongate groove structure have cross-sectional shapes that provide outer edges that are lower than inner edges.

In one embodiment, the elongate protuberant structure includes at least one aligning member extending upwardly therefrom away from said lower edge-defining structure and being tapered at a distal end thereof; and wherein said elongate groove structure includes at least one aligning cavity extending inwardly therein toward said upper edge-defining structure, said aligning cavity cooperating with said aligning member of the subjacent panel when positioned appropriately relative to the building frame, in a manner of pivoting interlock, to guide the panel in place over the subjacent panel, the aligning member and the aligning cavity making contact before said elongate groove structure contacts said elongate protuberant structure of the subjacent panel.

Typically, the aligning member has a height and said aligning cavity has a depth, said height and said depth being selected to provide a gap between the elongate groove structure and the elongate protuberant structure of the subjacent panel.

Alternatively, the aligning member includes a grasping feature. Typically, the grasping feature is a transverse through hole.

In one embodiment, the aligning member is a pin, and said aligning cavity is a pin hole. Typically, the pin is generally square, or round, in cross-section.

In one embodiment, the aligning member is a tenon, and said aligning cavity is a mortise.

In one embodiment, the elongate protuberant structure includes a plurality of coplanar and spaced-apart said aligning members, and wherein said elongate groove structure includes a plurality of coplanar and spaced-apart said aligning cavities, each said aligning cavities cooperating with a corresponding said aligning member of the subjacent panel when positioned appropriately relative to the building frame.

In one embodiment, the planar body further includes: at least one horizontal compliant sealing structure for interposing between the elongate groove structure and the elongate protuberant structure of the subjacent panel, and vertical compliant sealing structures for operatively interposing between the oblique vertical mating structures and the corresponding vertical connector strips.

Conveniently, the horizontal compliant sealing structure is attached to the protuberant structure, and each said vertical compliant sealing structure is attached to the corresponding vertical connector strip.

In one embodiment, the elongate protuberant structure and said generally complementarily compatible elongate groove structure have cross-sectional shapes that provide outer edges that are lower than inner edges.

In one embodiment, the oblique vertical mating structures comprise single planar surfaces.

In one embodiment, the oblique vertical mating structures comprise a plurality of surfaces.

In one embodiment, the oblique vertical mating structures comprise a plurality of oblique surfaces interconnected with reentrant surfaces.

According to another aspect of the present invention, there is provided a wall-surface building panel system securable to a structural building frame, the panel system comprises a plurality of building panels as hereinabove described interfacing with one another in a vertical direction and with a plurality of vertical connector strips in a horizontal direction, said connector strips being mountable on the building frame.

In one embodiment, the connector strips have an interpanel included angle selected from the group ranging from about ninety degrees to about three hundred and sixty degrees.

In one embodiment, the system further includes means for securing the planar panel body to the structural building frame.

Conveniently, the panel securing means includes a plurality of threaded fasteners or quick-connect fasteners.

According to a further aspect of the present invention, there is provided a method for applying a wall-surface building panel system securable to a structural building frame, the panel system comprising a plurality of building panels as claimed in claim 1 interfacing with one another in a vertical direction and with a plurality of vertical connector strips in a horizontal direction, said connector strips being connected to the building frame, said method comprises the steps of:

a) assembling said building panel releasably, pivotally and load-supportively over the subjacent panel in the first position with a non-coplanar, angle relationship with the wall surface; and b) moving said building panel from the first position non-coplanar with the wall surface, to the second position generally coplanar with the wall surface.

In one embodiment, the method further includes, before step a), the step of attaching the connector strips to the building frame.

In one embodiment, the method further includes the step of securing said building panel to the structural building frame.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein:

FIG. 7 to 9 are partially broken enlarged vertical section views taken along line 7-7 of FIG. 1, particularly illustrating a panel assembly sequence.

DETAILED DESCRIPTION OF THE PREFERRED EMBODIMENTS

With reference to the annexed drawings the preferred embodiments of the present invention will be herein described for indicative purpose and by no means as of limitation.

Figure 1:
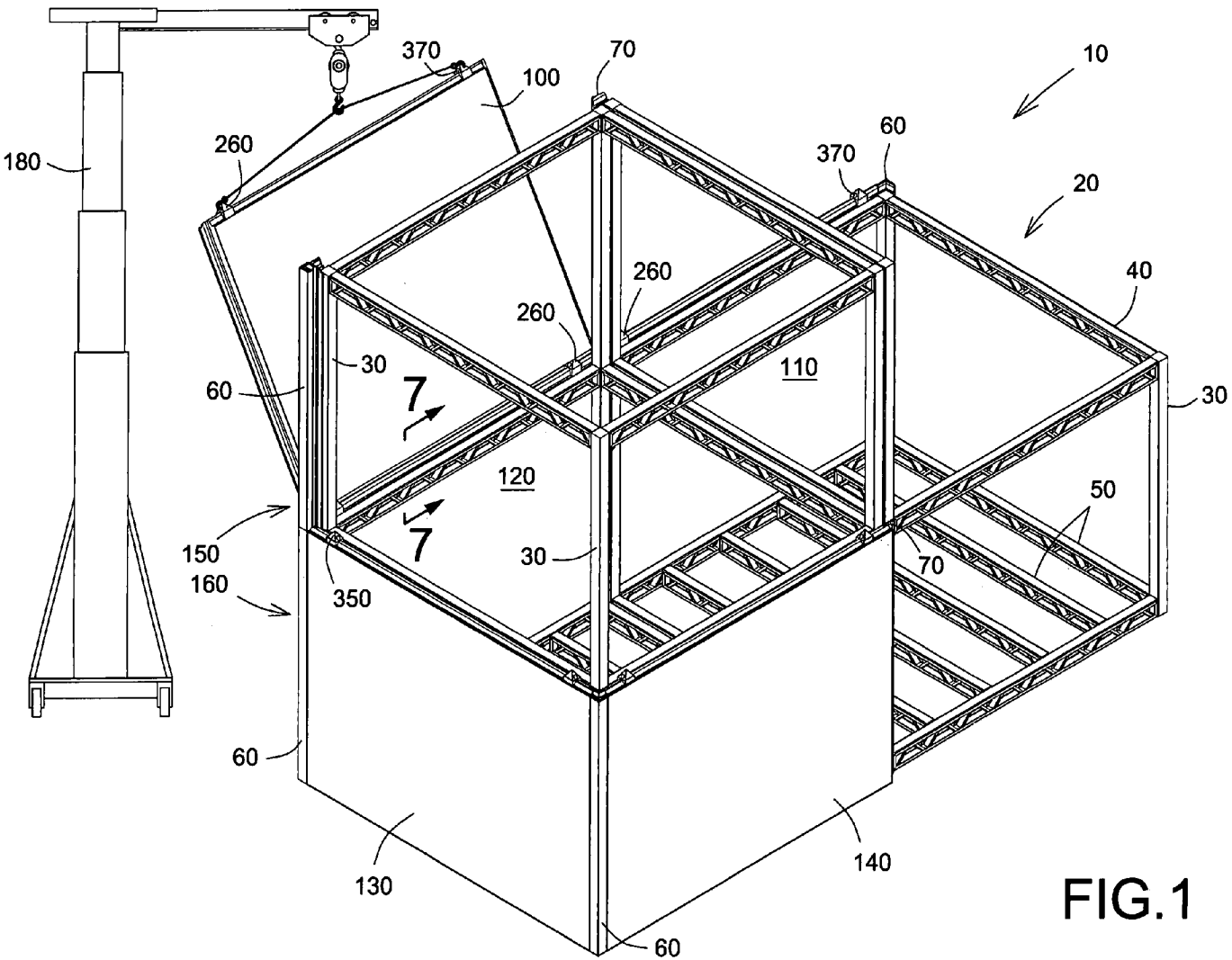
FIG. 1 is an isometric view of a building structure which is having surface panels installed in accordance with an embodiment of the present invention.

Referring to FIG. 1, building panels 100, 110, 120, 130 and 140 in accordance with the preferred embodiment of the present invention are shown in a building construction 10. The building construction 10 includes a main structure 20 formed with upright columns, such as the columns shown at 30, which columns are interconnected by horizontal beams 40. The horizontal beams 40 further act to support the floor beams 50, which are arranged in a generally parallel manner between the horizontal beams and are suitably spaced to support floor loads. In FIG. 1 it will be further observed that the upright columns 30 have connected to them vertical connector strips, such as for example vertical connector strips 60 and 70.

In the particular structural arrangement which is pictured in FIG. 1 as an example, a simple three-cell structure is apparent. Appropriately mounted on the outside thereof are panels, generally shown at 100, 110, 120, 130 and 140, which are (a) modular in nature, (b) generally planar, and (c) rectilinear in perimetral outline. With respect to the panels illustrated in FIG. 1, these panels lie in a substantially common plane and are disposed in a row-and-column arrangement. It is readily apparent that the structure comprises two stories, the lower story being partially enclosed by wall-surface panels 110, 120, 130 and 140. It is further apparent that the first panel 100 of the second story wall surface is being positioned for assembly in a pivoting manner taking advantage of the improved characteristics of the invention.

In the particular structural arrangement which is pictured in FIG. 1, as aforesaid, two stories 150 and 160 are illustrated, and it will be noted that each of the panels in FIG. 1 has a vertical dimension which is substantially the same as the story heights in building 10. It should be understood that such a vertical dimension for the panels 100 of the invention is not a critical dimension. Stated otherwise, panels 100 can be made in accordance with the present invention which may have different, specific, vertical dimensions in relation to a single, building-story height.

Also, panels 100 in accordance with the present invention may be sectioned in order to initiate or finalize a columnar assembly of panels. Thus a sectioned start panel (not shown) would be positioned and connected at the bottom of the building structure to initiate a column of building panels, and a sectioned cap panel (not shown) would analogously be used at the top of the column to finalize the column. The skilled person will realize that the start panels and the cap panels can have irregular vertical dimensions in accordance with the building design.

Furthermore, in the particular structural arrangement which is pictured in FIG. 1, it will also be noted that each of the panels are alike with respect to their lack of fenestration. It should be understood that existence or absence of fenestration on a particular panel is not critical to the present invention. Reiterating, fenestrated building panels may be made in accordance with the present invention, just as well as unfenestrated building panels.

The aforementioned vertical corner connector strips 60 and 70 are designed to interact complementarily with the lateral edges of the panel assembly. This will subsequently be described. It is important to understand vertical connector strips may be provided, in accordance with the present invention, integrally with or for attachment to the columns. As an example, with reference to FIGS. 4, 5, and 6, attachable vertical connector strips 430, 520 and 620, are illustrated, as internal corner, flat corner and external corner strips, respectively.

Figure 5:
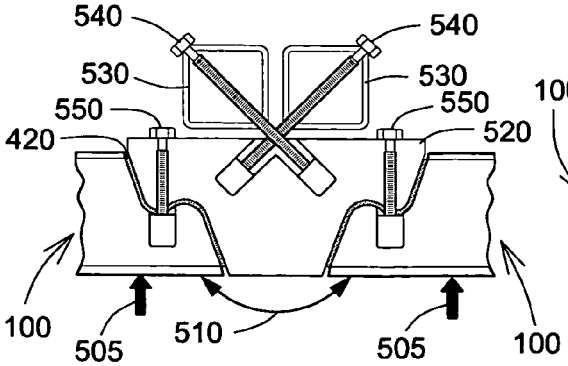
FIG. 5 is a partially broken enlarged horizontal section view of the embodiment of FIG. 1, particularly illustrating a coplanar panel connection.

With respect to the embodiment of the present invention which is specifically pictured in FIG. 5, one will see that the vertical connector strip 520 is connected to the structural columns 530 by the use of a plurality of bolt-and-insert pairs 540 vertically spaced from one another for proper securing thereof (not illustrated in FIG. 1 for clarity purposes).

The skilled person will appreciate that other connector arrangements will be satisfactory for use in the present invention for connecting the vertical connector strips to the structural columns. Examples of other connector arrangements are welding, riveting, bonding and clips system with tie rods. Furthermore the vertical connector strips 430, 520, 620 can also be manufactured integrally with the structural columns 30. Summarizing, the skilled person will appreciate that the vertical connector strips can be connected to the structural columns or manufactured integrally with the structural columns and still be within the scope and spirit of the present invention.

Figure 2:
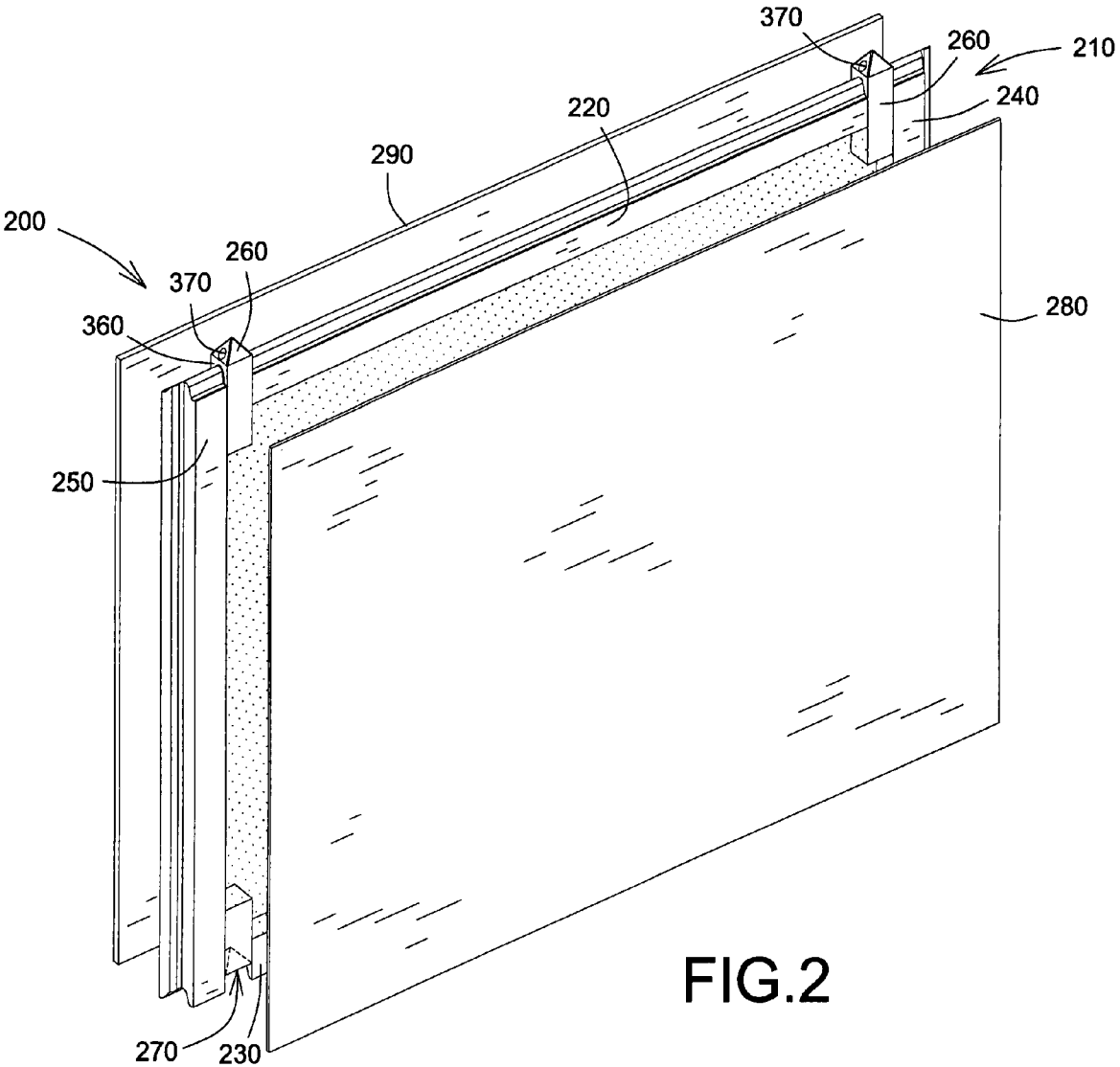
FIG. 2 is an enlarged exploded isometric view of the embodiment of FIG. 1.

Referring more specifically to FIG. 2, there is schematically shown an isometric exploded view of a building panel 200 embodying the present invention. As can be seen, the building panel has a generally planar shaped body. A peripheral frame sub-assembly 210 comprises upper and lower edge-defining structures 220 and 230 respectively, lateral edge-defining structures 240 and 250, aligning members 260, and aligning cavities 270. An inner face sheet 280, and an outer face sheet 290 are attached to the peripheral frame sub-assembly 210, the internal defined space of which could be filed with heat insulating, fire retardant, and the like type materials whenever required. The specific constructions of the sub-components of the panel assembly do not form any part of the present invention.

Figure 3:
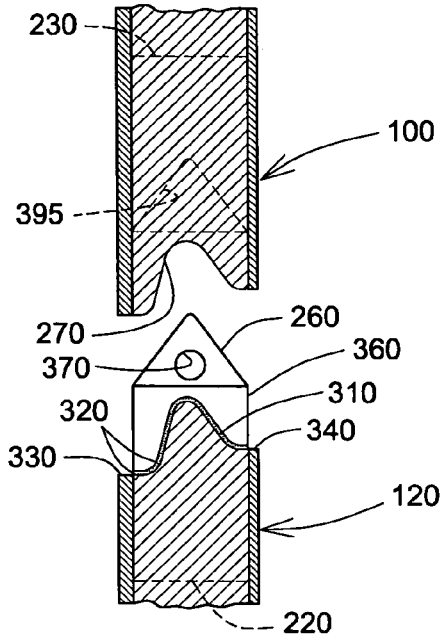
FIG. 3 is a partially broken enlarged and exploded transverse vertical section view of the embodiment of FIG. 1, particularly illustrating an aligning member and an aligning cavity.

On closer inspection, the upper and lower edge-defining structures 220, 230 as well as the lateral edge-defining structures 240, 250 are seen to have surfaces that are related to the present invention. FIG. 3 provides more detail and is now referred to.

In FIGS. 2 and 3, the upper edge-defining structure 220 features along its length a protuberant structure 310 operatively associated therewith in the plane of the panel body and on which is typically affixed a compliant sealing structure 320. In this preferred embodiment 120 of the invention, the outer edge 330 of the protuberant structure 310 is typically leveled with or lower than the inner edge 340 thereof, and the slope of the external side thereof (left hand side of FIG. 3) is typically steeper than the slope of the internal side, for reasons of allowing smooth insertion of a panel over a subjacent panel for easier assembly thereof and to prevent water infiltration when assembled. Furthermore, at least one, preferably two spaced-apart, aligning member 260 extends vertically upwardly from the upper edge-defining structure 220. The distal end 360 of the aligning member is substantially tapered (or eventually rounded—not shown) and further features a convenient grasping feature such as a transverse through-hole 370 for lifting. The building panel 100 has at its lower extent and extending along the length of the lower edge-defining structure 230 a groove structure 390 operatively associated therewith in the plane of the panel body. Recessed into the groove structure 390 is at least one, preferably two spaced-apart, vertically-directed aligning cavity 270.

The interactions of the aligning members 260 and cavities 270 will be described in subsequent paragraphs. In relation to the compliant sealing structures in FIGS. 3 and 9, the aligning members 260 and cavities 270, when fully engaged, define a fit dimension 930 between each corresponding protuberant and groove structures 310, 390 both shaped to be in close cooperation and generally complimentarily compatible with each other. As is well known to the skilled person, a controlled fit dimension 930 is important for sealing integrity, since by this manner the correct squeeze or compression ratio within a required range can be achieved and thereby the desired functioning of a compliant sealing structure 320 can be obtained.

Figure 4:
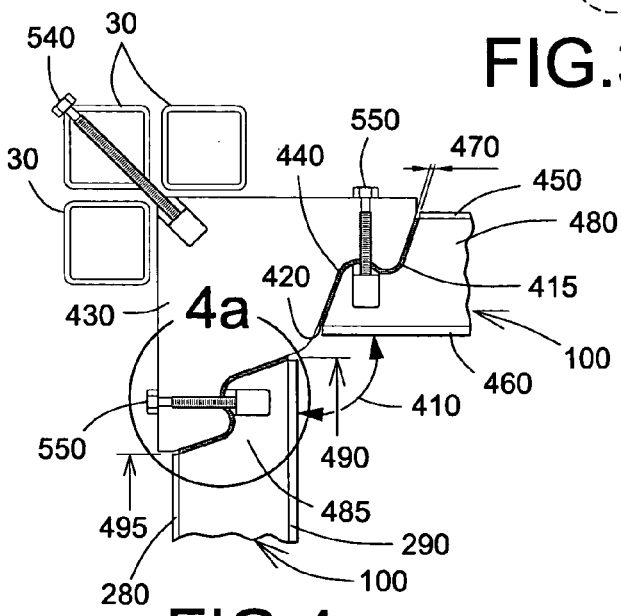
FIG. 4 is a partially broken enlarged horizontal section view of the embodiment of FIG. 1, particularly illustrating an internal corner assembly.
Figure 6:
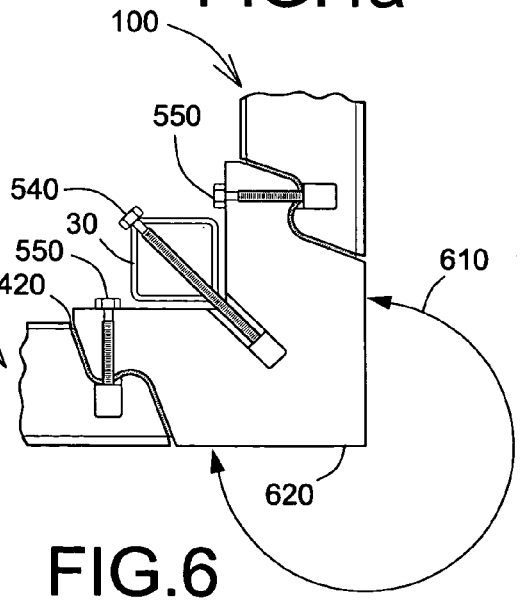
FIG. 6 is a partially broken enlarged horizontal section view of the embodiment of FIG. 1, particularly illustrating an external corner assembly.

FIGS. 4, 5 and 6 depict, among other features, the vertical mating interfaces. FIG. 4 illustrates two inventive building panels 100, each juxtaposed with the corresponding vertical connector strip 430, compliant sealing structures 420 being interposed between each building panel 100 and the corresponding vertical connector strip surface, to form an internal corner. That is, the included angle 410 between the building panels 100 is about ninety degrees. Next, FIG. 5 illustrates a vertical connector strip 520 for planar connections, that is, the included angle 510 between the building panels 100 is about one hundred and eighty degrees. Subsequently, FIG. 6 shows an external corner strip 620, that is, the included angle 610 between the building panels 100 is about two hundred and seventy degrees.

It is important to understand that the invention is not limited to the three aforementioned configurations of generally ninety degrees, one hundred and eighty degrees, and two hundred and seventy degrees, respectively. Rather, the inventive building panels 100 may be used at any appropriate included angle, according to the building design, as will be apparent to the skilled person. The skilled person will appreciate that an included angle of about ninety degrees, especially less than ninety degrees, requires consideration of the design of the vertical connector strips. The vertical connector strips 430, 520, 620 are designed to provide a sufficient installation envelope for each building panel 100. Without a sufficient installation envelope, particularly at included angles less than ninety degrees, building panels may contact adjacent building components, hindering assembly of the building panels 100 according to the present invention.

Figure 4A:
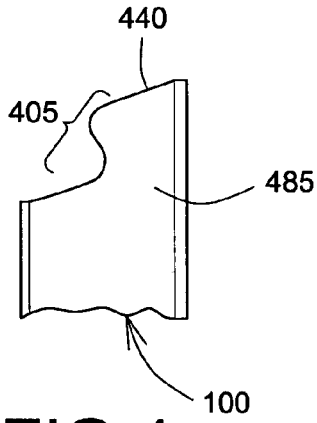
FIG. 4*a* is an enlarged broken section view taken along line 4*a* of FIG. 4, with some parts being removed for clarity.

Returning now to the explanation of the vertical mating interfaces, and referring to FIGS. 4 and 4*a*, a compliant sealing structure 420 is operatively interposed between the vertical connector strip 430 and the corresponding oblique vertical mating structure 440. The compliant sealing structure 420 in this preferred embodiment is typically affixed to the vertical connector strip 430. The compliant sealing structure 420 is disposed to contact the corresponding oblique vertical mating structure over a substantial surface area bounded, for example, by the inner extents of the face sheets 450 and 460. Also, gap 470 is formed between each face sheet and the nearest vertical connector strip surface (or between two laterally adjacent panels as in FIG. 5), which may optionally be filled with a convenient caulking material or the like. The gap dimension, controlled by the panel aligning cavities 270 engaged by the respective aligning members 260, and shape is adaptable to a particular building design. For example, the gap 470 may optionally have non-parallel, outwardly-divergent sides.

For use in the preferred embodiment, compliant sealing structures 320 and 420 in the form of gaskets made of rubber or the like have been found satisfactory. The skilled person will appreciate that other compliant sealing structure materials such as caulking and the like can be used to practice the invention and are understood to be represented by the term "compliant sealing structure". The skilled person will further appreciate that compliant sealing structures such as sealing mastics and the like will still be within the scope and spirit of the present invention.

The assembly sequence involves the horizontal as well as the vertical mating surfaces. The assembly sequence as it pertains to the horizontal mating surfaces is now explained with reference to FIGS. 1, 7, 8 and 9. The simultaneous interaction of the vertical mating surfaces will be handled in subsequent paragraphs.

The pivoting assembly activity as illustrated in FIGS. 1 and 7 is initially carried out, as aforesaid, by coarsely positioning the building panel 100 over the subjacent panel 120 in order to ensure proper engagement of the building panel's aligning cavities 270 with the aligning members 260 of the subjacent panel 120. In such a manner the building panel 100 is suitably positioned in a first installation non-coplanar position within an initial out-of-plane relationship to the subjacent panel 120, as indicated by angle 700 in FIG. 7.

At this stage the weight of the building panel 100 is supported partially by the aligning members 260 of the subjacent panel 120; the rest of the panel's weight is supported by a lifting apparatus 180 engaged to the lifting holes 370, as seen in FIG. 1. At this point, contact has not yet been established with the horizontal compliant sealing structure 320 on the subjacent panel 120.

Since in the manner of the preceding paragraph the horizontal compliant sealing structure 320 remains spaced away and substantially unaffected during the initial assembly process, the risk of sealing structure damage during assembly is reduced. As shown in FIG. 7, the building panel 100 is then displaced in a combined lowering and generally pivoting motion, as schematically indicated by arrow 705, while guided at its lower end by the partially coupled aligning member-aligning cavity pairs. Thus the building panel 100 passes through an intermediate position as depicted in FIG. 8.

When the tapered distal ends 360 of the aligning members 260 have sufficiently engaged the respective aligning cavities 270, the building panel 100 can achieve the in-plane orientation seen in FIG. 9. The second installed in-plane or co-planar position of the building panel 100 is determined by the full engagement of the aligning cavity 270 on the subjacent respective aligning member 260, and the aforesaid fit 930 exists in which is accommodated the compliant sealing structure 320. In the installed position of the preferred embodiment, the adjacent face sheets 910 and 920 do not abut; the resulting transversal gap 940 can optionally be filled with a convenient caulking material or the like. The size, shape and proportions of the gap 940 are optional.

As aforementioned, towards the end of the assembly sequence the vertical mating surfaces will also engage, due to the panel motion generally described by arrow 805 in FIG. 8. In this preferred embodiment, the vertical mating structure assemblies are seen in FIGS. 4 to 6. The lateral edge-defining structures 480, 485 on each building panel 100 are of a generally faceted nature, so that the outer width 490 of the outer face sheet 290 of the building panel is greater than the inner width 495 of the inner face sheet 280 of the building panel. The mating contour 415 of the vertical connector strip 430 is shaped to be in close cooperation and generally complimentarily compatible with the oblique vertical mating structure 440 of the lateral edge-defining structure 240, 250 of the panel 100. The compliant sealing structure 420 is typically and preferably attached to the vertical connector strip 430. In this preferred embodiment, the oblique vertical mating structure 440 further features a reentrant section 405 which has been found to provide improved resistance to air leakage, drafts, and the like, as shown in FIG. 4*a*.

It is further apparent that the vertical mating surfaces are shaped to engage in a direction vertically perpendicular to the plane of the wall surface formed by the building panels 100, 120, as schematically shown by arrows 505 in FIG. 5. During the final phase of the aforesaid assembly sequence depicted in FIGS. 7 to 9, the vertical mating surfaces seen in FIG. 4 engage in a manner that substantially reduces sliding contact between each oblique vertical mating structure 440 and the corresponding vertical connector strip 430 during assembly. Thus, according to the features of the present invention, the integrity of the vertical compliant sealing structures 420 is improved.

The aforementioned description of the vertical mating interfaces is equally applicable to the configurations in FIGS. 5 and 6, as well as any other configuration according to the present invention.

The building panel once in the in-plane position is then connected to the building structure as seen in FIGS. 4 and 5. The two building panels 100 depicted are typically bolted to the vertical connector strips 520 (see FIGS. 4 to 6) or eventually therethrough to the building structure (not shown) with bolt-and-insert pairs 550 (not illustrated in FIG. 1 for clarity purposes). In an alternative embodiment of the invention, quick-connect fasteners such as, for example, quarter-turn tightening fasteners, preferably with pre-selected compressive load springs, are used to connect the building panels 100 to the structural columns 530. In such manner the building loads for example wind loads are transmitted from the building panels 100 through the connector strips 520 to the building structure 530. The skilled person will appreciate that other types of connectors and load paths will be satisfactory for use in the present invention.

It must be emphasized that the choice of sealing technology does not form a part of the present invention. Furthermore the technology used to attach the compliant sealing structures 320, 420 to the building panels 100 and the vertical connector strips 430, 520, 620 is not part of the present invention. In addition, the compliant sealing structure may be omitted from one or more of the mating surfaces between the building panels and the vertical connector strips; the skilled person will appreciate that such an arrangement will still be within the scope and spirit of the present invention.

In an embodiment of the present invention, compliant sealing structures 320, 420 are present on all mating surfaces on the building panels as well as the vertical connector strips. That is, with respect to the building panels, compliant sealing structures are typically connected to each protuberant structure, to interface with each groove structure, and each oblique vertical mating structure. Furthermore, compliant sealing structures are connected to each vertical connector strip surface.

In a further embodiment of the present invention, the compliant sealing structures are absent from the building panel mating surfaces. Instead, the protuberant 310 and groove 390 structures are shaped in a tightly close-fitting manner. The vertical mating interfaces are similarly arranged in a tightly close-fitting manner, so that there is no space between the mating surface of the vertical connector strip and the corresponding mating surface 415 of the oblique vertical mating structures 440. Thus, all the mating surfaces provide sealing through their precise, tight-fitting proximity. The other advantages and features of the present invention remain.

In yet another embodiment of the present invention, the upper 220 and lower 230 edge-defining structures and optionally the lateral edge-defining structures 240, 250 are multi-lobed, corrugated interfaces, covered sealing membranes and the like.

An embodiment of a method of the present invention is now set forth. A building main structure is constructed having vertical connector strips. The building panels and the vertical connector strips have pre-affixed compliant sealing structures. A start panel comprising a protuberant structure and typically two spaced-apart aligning members is positioned and connected to the building structure at the lowest position of a planned column of building panels. Optionally, a plurality of start panels can be positioned and connected to the building structure in order to create the appropriate lateral spacing, involving the start panels and the vertical connector strips, for a plurality of the planned columns of building panels.

The first building panel is then lifted, making use of the convenient transverse through-holes 370 on the aligning members 260, and hoisted to close proximity with the building structure. The first building panel is tilted so that its upper edge is farthest away from the building side, and the lower edge is coarsely positioned above and generally parallel to the upper edge of the start panel (or subjacent panel).

The first building panel's lower edge is brought closer to the start panel's upper edge so that the aligning cavities 270 are engaged by the respective aligning members 260 of the start panel. The first building panel is thus in an initial out-of-plane relationship to the building side, and the panel's weight is supported partially by the hoist and partially by the start panel's aligning members 260.

The first building panel is then simultaneously lowered while its upper edge is brought closer to the building side. As shown in FIG. 7, the aligning cavities 270 continue to be engaged by the aligning members 260 as seen by the insertion direction 705. In such a manner the aligning cavities are generally vertically engaged by the aligning members in a sliding movement therealong as seen in FIG. 8; no substantial contact has yet been made between the lateral edge-defining surfaces and the vertical connector strips.

Since the majority of the vertical engagement has taken place at this stage, the final panel motion is then a pivoting motion 805 which shuts the panel's lateral edge-defining surfaces perpendicularly into the corresponding surfaces on the vertical connector strips (see arrows 505 of FIG. 5). At the end of the pivoting motion 805 the first building panel has reached the final position as seen in FIG. 9 and the vertical compliant sealing structures have made full surface contact without having experienced any substantial relative in-plane motion.

The first building panel is then connected by its vertical edges to the building structure using a structurally-suitable number of bolt-insert pairs 550 as seen in FIG. 5. Using the aforementioned sequence, additional building panels are assembled upward columnarly as well as row-wise laterally until the building side is complete including the cap panels.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A wall-surface building panel securable to a structural building frame having vertical connector strips connected thereto, said panel comprising:

a generally planar panel body having elongate opposite upper and lower edge-defining structures, and elongate opposite first and second lateral edge-defining structures extending therebetween, said panel body having an outer width and an inner width;

an elongate protuberant structure operatively associated with, and extending along, the upper edge-defining structure generally in a plane of the body;

an elongate groove structure operatively associated with, and extending along, the lower edge-defining structure generally in the plane of the body, and being generally complementarily compatible with said protuberant structure;

oblique vertical mating structures operatively associated with, and extending along, the first and second lateral edge-defining structures, complementarily compatible with the corresponding vertical connector strips, wherein the oblique vertical mating structures are arranged so that the outer width of the planar panel body is greater than the inner width thereof;

wherein the elongate protuberant structure of a subjacent panel is shaped to releasably, pivotally and load-supportively interface with the elongate groove structure of said panel, said interfacing enabling a range of motion of said panel relative to the subjacent panel;

wherein said range of motion ranges from a first position non-coplanar with the wall surface, to a second position generally coplanar with the wall surface;

wherein said range of motion substantially reduces sliding contact between each said oblique vertical mating structures and corresponding said vertical connector strip; and wherein said elongate protuberant structure and said generally complementarily compatible elongate groove structure have cross-sectional shapes that provide outer edges that are lower than inner edges.

2. The building panel of claim 1, wherein said elongate protuberant structure includes at least one aligning member extending upwardly therefrom away from said lower edge-defining structure and being tapered at a distal end thereof, and wherein said elongate groove structure includes at least one aligning cavity extending inwardly therein toward said upper edge-defining structure, said aligning cavity cooperating with said aligning member of the subjacent panel when positioned appropriately relative to the building frame, in a manner of pivoting interlock, to guide the panel in place over the subjacent panel, the aligning member and the aligning cavity making contact before said elongate groove structure contacts said elongate protuberant structure of the subjacent panel.

3. The building panel of claim 2, wherein said aligning member has a height and said aligning cavity has a depth, said height and said depth being selected to provide a gap between the elongate groove structure and the elongate protuberant structure of the subjacent panel.

4. The building panel body of claim 2, wherein said aligning member includes a grasping feature.

5. The building panel of claim 4, wherein said grasping feature is a transverse through hole.

6. The building panel of claim 2, wherein said aligning member is a pin, and said aligning cavity is a pin hole.

7. The building panel of claim 6, wherein said pin is generally square in cross-section.

8. The building panel of claim 2, wherein said aligning member is a tenon, and said aligning cavity is a mortise.

9. The building panel of claim 2, wherein said elongate protuberant structure includes a plurality of coplanar and spaced-apart said aligning members, and wherein said elongate groove structure includes a plurality of coplanar and spaced-apart said aligning cavities, each said aligning cavities cooperating with a corresponding said aligning member of the subjacent panel when positioned appropriately relative to the building frame.

10. The building panel of claim 1, wherein said planar body further includes:

at least one horizontal compliant sealing structure for interposing between the elongate groove structure and the elongate protuberant structure of the subjacent panel, and vertical compliant sealing structures for operatively interposing between the oblique vertical mating structures and the corresponding vertical connector strips.

11. The building panel of claim 10, wherein said horizontal compliant sealing structure is attached to the protuberant structure, and each said vertical compliant sealing structure is attached to the corresponding vertical connector strip.

12. The building panel of claim 1, wherein said oblique vertical mating structures comprise single planar surfaces.

13. The building panel of claim 1, wherein said oblique vertical mating structures comprise a plurality of surfaces.

14. The building panel of claim 1, wherein said oblique vertical mating structures comprise a plurality of oblique surfaces interconnected with reentrant surfaces.

15. A wall-surface building panel system securable to a structural building frame, the panel system comprising a plurality of building panels as claimed in claim 1 interfacing with one another in a vertical direction and with a plurality of vertical connector strips in a horizontal direction, said connector strips being mountable on the building frame.

16. The building panel system of claim 15, further including means for securing the planar panel body to the structural building frame.

17. The building panel system of claim 16, wherein the panel securing means includes a plurality of threaded fasteners.

* * * * *